United States Patent [19]

Bach

[11] 4,265,970

[45] May 5, 1981

[54] ACRYLIC FIBER HAVING IMPROVED DYEABILITY

[75] Inventor: Hartwig C. Bach, Pensacola, Fla.

[73] Assignee: Monsanto Company, St. Louis, Mo.

[21] Appl. No.: 157,127

[22] Filed: Jun. 6, 1980

[51] Int. Cl.[3] ..... D02G 3/00

[52] U.S. Cl. ..... 428/364; 428/373; 428/374; 525/178; 525/183

[58] Field of Search ..... 428/364, 373, 374; 525/178; 260/DIG. 23, DIG. 32

[56] References Cited

U.S. PATENT DOCUMENTS 2,632,748 3/1953 Caldwell ..... 525/183 X

FOREIGN PATENT DOCUMENTS 45-2773 1/1970 Japan ..... 525/178

1409258 10/1975 United Kingdom ..... 525/183

*Primary Examiner*—Lorraine T. Kendell

*Attorney, Agent, or Firm*—Robert L. Broad, Jr.; John W. Whisler

[57] ABSTRACT

An acrylic fiber having improved basic dyeability and hot/wet properties, the fiber being made up of a blend of (a) at least 60 weight percent of a polymer of at least 35 weight percent of acrylonitrile copolymerized with up to 65 weight percent of at least one other mono-olefinic monomer and a minor amount of a sulfonated vinyl monomer with (b) 0.5 to 40 weight percent of the polyterephthalamide of a mixture of 2,2,4 and 2,4,4 trimethyl hexamethylene diamine, the fiber being made up of a two-phase heterogeneous suspension of the polyterephthalamide in a continuous phase of the acrylic polymer. Without the sulfonated vinyl monomer the fiber will have superior hot/wet properties but will show no improvement in dyeability, the dyeability of the fiber being enhanced only when the sulfonated vinyl monomer is present as a part of the acrylic polymer chain.

4 Claims, No Drawings

ACRYLIC FIBER HAVING IMPROVED DYEABILITY

BACKGROUND OF THE INVENTION a. Field of the Invention

This invention relates to acrylic fibers having improved dyeability and hot/wet properties.

b. Description of the Prior Art

It is known to utilize various additives to acrylic fibers to enhance the dyeability of these fibers. It is also known to utilize additives to enhance the normally poor hot/wet properties of acrylic fibers. Generally, the additives which enhance dyeability do not improve the hot/wet properties of the fiber and those additives which enhance the hot/wet properties of the fiber do not improve the dyeability of the fiber.

The additive used in the present invention enhances the hot/wet properties of an acrylic fiber and enhances both hot/wet properties and basic dyeability when the fiber contains a minor amount of a sulfonated vinyl monomer as part of the polymer chain.

SUMMARY OF THE INVENTION

An acrylic fiber having improved dyeability and hot-wet properties, the fiber being made up of (a) at least 60 weight percent of a polymer of at least 35 weight percent of acrylonitrile copolymerized with up to 65 weight percent of at least one other mono-olefinic monomer and a minor amount of a sulfonated vinyl monomer and (b) 0.5 to 40 weight percent of the polyterephthalamide of a mixture of 2,2,4 and 2,4,4 trimethyl hexamethylene diamine, the fiber being made up of a two-phase heterogeneous suspension of the polyterephthalamide in a continuous phase of the acrylic polymer. Without the sulfonated vinyl monomer the fiber shows no improvement in dyeability.

DETAILED DESCRIPTION OF THE INVENTION

In this invention a solution of the polyterephthalamide of a mixture of 2,2,4 and 2,4,4 trimethyl hexamethylene diamine is mixed with a spinning dope made of an acrylic polymer dissolved in a suitable solvent. It is preferred that the same solvent be used for dissolving both the polyterephthalamide and the acrylic polymer, either together or separately. Preferred solvents are dimethyl acetamide, dimethyl formamide and dimethyl sulfoxide, with dimethyl acetamide being most preferred. The spinning dope made up of these two mixed solutions, or single solutions when the polymers are dissolved together, is then spun into fibers in a conventional manner. The polyterephthalamide additive will be dispersed through the spinning dope as a separate distinct phase, so that in the spun fiber the polyterephthalamide will be dispersed throughout the fiber. The fiber will thus be made up of a two-phase, heterogenous, finely-divided suspension of the polyterephthalamide in a continuous phase of the acrylic polymer.

An acrylic fiber containing this additive will exhibit improved hot/wet properties. If the acrylic fiber contains a sulfonated vinyl monomer as part of the polymer chain, as preferred, the additive also enhances the basic dyeability of the fiber. If no sulfonated vinyl monomer is present as part of the acrylic polymer, the additive has no effect on fiber dyeability.

The fiber will contain 0.5 to about 40 weight percent of the polyterephthalamide, and will preferably contain 10 to 25 weight percent of the polyterephthalamide.

The acrylic polymer and the polyterephthalamide may be dissolved simultaneously in a common supply of the solvent or individual polymer solutions may be made separately and then mixed to form a spin dope. The spin dope should contain a total of about 20–25 weight percent of the dissolved materials.

The polymer should be made up of at least 35 weight percent of acrylonitrile copolymerized with up to 65 weight percent of at least one other mono-olefinic monomer copolymerizable with acrylonitrile. Preferably, the polymer will contain at least 85 weight percent of acrylonitrile and 1–10 weight percent of the sulfonated vinyl monomer.

The spinning of the fibers is carried out by a conventional wet spinning process. The fiber properties disclosed in the examples below were obtained by conventional methods.

If enhanced basic dyeability is desired, as is preferred, the fiber should contain about 1–10 weight percent of a sulfonated vinyl monomer such as vinyl benzene sulfonate or sodium sulfophenyl methallyl ether. Sodium sulfophenyl methallyl ether is preferred. Sulfonated vinyl monomers are well known.

EXAMPLE I

A 20 weight percent polymer solution in dimethylacetamide (DMAC) of a mixture of 85 parts of an acrylic copolymer of 93 weight percent acrylonitrile and 7 weight percent vinyl acetate with 15 parts of the polyterephthalamide was wet spun from a 25-hole-3 mil spinnerette into a spinbath containing a mixture of 65 percent DMAC and 35 percent water at a temperature of 38° C. The fiber bundle was washed and stretched 6X in boiling water and then dried and wound up on a bobbin. The fibers had the following tensile properties:

| | |
|---|---|
| Tenacity: | 2.9 gpd |
| Elongation: | 12.9% |
| Initial Modulus: | 68 gpd |
| Toughness: | 0.23 |
| Tensile factor: | 10.4 |

Using the same spinning procedures, a 20 percent solution of the acrylic polymer (control) without the polyterephthalamide yielded fibers with the following tensile properties:

| | |
|---|---|
| Tenacity: | 2.0 gpd |
| Elongation: | 8% |
| Modulus: | 69 gpd |
| Toughness: | 0.11 |
| Tensile factor: | 5.7 |

After being shrunk to about one-third of the original length at a temperature of about 175° C. the filaments had the following characteristics:

| | Polymer A | Control |
|---|---|---|
| Tenacity, gpd | 2.7 | 2.0 |
| Elongation, % | 20.1 | 15.8 |
| Tensile factor | 12.1 | 7.9 |

EXAMPLE II

The polymer solution blend of Example I was spun into fibers in a 70/30 DMAC/$H_2O$ spinbath at 38° C. The fibers received a jet stretch of 0.2 in the spinning step and were then washed in a boiling water cascade while being stretched 8.5X. The fibers were then shrunk to 37% of their stretched length. The fibers then had the following characteristics:

| | As Spun | Shrunk |
|---|---|---|
| Tenacity, gpd | 4.0 | 3.7 |
| Elongation % | 18.7 | 24.8 |
| Modulus gpd | 59 | 52 |
| Toughness | 0.41 | 0.49 |

The same polymer blend was spun into the 75/25 DMAC/$H_2O$ spinbath at 38° C. with a jet stretch of 0.3, a stretch of 9X in a boiling water cascade and the spun fibers were shrunk to 37% of its as spun length. This yarn had a tenacity of 4.1 gpd, an elongation of 24.7% a modulus of 52 gpd and a toughness of 0.52. The polymer without the polyterephthalamide could not be spun into fiber in either of the 70/30 or the 75/25 DMAC/-$H_2O$ spinbath.

EXAMPLE III

A yarn obtained by spinning the blend of Example I into a 70/30 DMAC/$H_2O$ spinbath with a jet stretch of 0.2 and a cascade stretch of 7.5 was hot drawn 4.3X at 175° C. to give a yarn which had a tenacity of 9.1 gpd, an elongation of 11.4% and a modulus of 128 gpd and a tensile factor of 30.7. After being steam annealed at 35 psi steam pressure, the fiber had average single filament properties of:

| | |
|---|---|
| Tenacity | 4.7 gpd |
| Elongation | 43.3% |
| Modulus | 42 gpd |

This fiber had a knot tenacity of 85.2% and a hot/wet modulus, in water at 93° C., of 1.2 gpd.

EXAMPLE IV

A solution blend of a first polymer of 93% acrylonitrile and 7% vinyl acetate, a second acrylic polymer of 84% acrylonitrile, 6.0% vinyl bromide and 10% sodium sulfophenyl methallyl ether to which was added 5 weight percent of the polyterephthalamide was spun to fibers which had an as-spun tenacity of 2.8 gpd and an elongation of 13.2%. After being dyed with Sevron Blue at 100° C. for two hours the fiber showed a dye uptake of 17.3%. A control fiber spun from the same polymers but without the polyterephthalamide showed a dye uptake of only 14.4%.

EXAMPLE V

A solution blend was prepared of 85 weight percent of an acrylic polymer containing 90.8 weight percent acrylonitrile and 9.2 weight percent vinyl bromide, 15 weight percent of a polymer containing 84% acrylonitrile, 6.0 weight percent vinyl bromide and 10 weight percent sodium sulfophenyl methallyl ether, the blend including 5 weight percent of the polyterephthalamide. Fibers formed from the blend were hot stretched at 175° C. and showed a tenacity of 8.7 grams per denier, an elongation of 9.9% and a tenacity of 157 gpd with a hot/wet modulus of 17.9 gpd. After steam annealing at 50 psi steam pressure the fibers had a tenacity of 6.7 gpd, an elongation of 21.6% and a modulus of 61.6 gpd with a hot/wet modulus of 4.9 gpd.

EXAMPLE VI

A 50/50 solution blend of an acrylic copolymer of 93% acrylonitrile and 7 weight percent vinyl acetate and the polyterephthalamide was wet spun to fiber in a 70/30 DMAC/$H_2O$ spinbath at 38° C. After shrinking the yarn 40% at 175° C. the fibers had a tenacity of 2.3 gpd, an elongation of 26.1% and a modulus of 39 gpd.

EXAMPLE VII

A blend of 90 weight percent of the polymer of Example VI and the 10% of the polyterephthalamide was wet spun and relaxed as in Example VI. Tensile properties of the fibers were:

| | |
|---|---|
| Tenacity: | 3.1 gpd |
| Elongation: | 20.5% |
| Modulus: | 56 gpd. |

EXAMPLE VIII

A solution blend of 98 weight percent of the polymer of Example VI and 2 weight percent of the polyterephthalamide was wet spun into a 75/25 DMAC/$H_2O$ spinbath at 38° C. to give yarn having a tenacity of 3.2 gpd, an elongation of 13.9% and a modulus of 67 gpd. Without the addition of the polyterephthalamide, this acrylic polymer could not be spun into fiber in this spinbath.

EXAMPLE IX

A solution of 99.5 weight percent of the polymer of Example VI and 0.5 weight percent of the polyterephthalamide were wet spun into a 65/35 DMAC/$H_2O$ spinbath at 38° C. The resulting yarn had a tenacity of 2.9 gpd, an elongation of 10.8% and a modulus of 76 gpd.

EXAMPLE X

A solution blend of 80 weight percent of the polymer of Example VI and 20 weight percent of an amorphous polyisophthalamide of hexamethylene diamine was wet spun into a 65/35 DMAC/$H_2O$ spinbath to give in-line heat-annealed filaments having a tenacity of 3.4 gpd, an elongation of 14.5% and a modulus of 66 gpd.

What is claimed is:

1. A fiber having improved hot/wet properties, said fiber being made up of a. at least 60 weight percent of a polymer of at least 35 weight percent of acrylonitrile copolymerized with up to 65 weight percent of at least one other mono-olefinic monomer copolymerizable with acrylonitrile, and b. 0.5 to 40 weight percent of the polyterephthalamide of a mixture of 2,2,4 and 2,4,4 trimethyl hexamethylene diamine, said fiber being made up of a two phase heterogeneous suspension of the polyterephthalamide in a continuous phase of said polymer.

2. The fiber of claim 1 wherein the fiber contains 10–25 weight percent of said polyterephthalamide.

3. An acrylic fiber having improved hot/wet properties and enhanced basic dyeability, said fiber being made up of:

a. an acrylic polymer containing 1–10 weight percent, based on fiber weight, of a sulfonated vinyl monomer as part of the polymer chain, and b. 10–25 weight percent, based on fiber weight of the polyterephthalamide of a mixture of 2,2,4 and 2,4,4 trimethyl hexamethylene diamine, said polyterephthalamide being dispersed through said fiber in the form of a discrete phase in a continuous phase of said acrylic polymer.

4. The fiber of claim 3 wherein the sulfonated vinyl monomer is sodium sulfophenyl methallyl ether.

* * * * *